US006177947B1

(12) United States Patent
Wen et al.

(10) Patent No.: US 6,177,947 B1
(45) Date of Patent: Jan. 23, 2001

(54) COLOR IMAGE FORMATION IN RECEIVERS HAVING FIELD-DRIVEN PARTICLES

(75) Inventors: Xin Wen, Rochester; Steven D. MacLean, Webster; William H. Simpson, Pittsford, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/054,092

(22) Filed: Apr. 2, 1998

(51) Int. Cl.[7] ..... G09G 3/16; G09G 3/34; G09G 3/30; B41J 2/475; B41J 2/385

(52) U.S. Cl. ..... 347/112; 347/114; 347/115; 347/153

(58) Field of Search ..... 347/112, 111, 347/114, 115, 153; 345/107; 359/296

(56) References Cited

U.S. PATENT DOCUMENTS

| | | | | |
|---|---|---|---|---|
| 3,612,758 | * | 10/1971 | Evans et al. . | |
| 4,143,103 | | 3/1979 | Sheridon . | |
| 4,305,807 | * | 12/1981 | Somlyody . | |
| 5,344,594 | | 9/1994 | Sheridon . | |
| 5,604,027 | | 2/1997 | Sheridon . | |
| 6,064,410 | * | 5/2000 | Wen et al. | 347/111 |

FOREIGN PATENT DOCUMENTS

WO 97/04398 2/1997 (WO) .

OTHER PUBLICATIONS

"A Newly Developed Electrical Twisting Ball Display", by Saitoh, et al, Proceedings of the SID, vol. 23/4, 1982, pp. 249–253.

* cited by examiner

*Primary Examiner*—Huan Tran
(74) *Attorney, Agent, or Firm*—Raymond L. Owens

(57) ABSTRACT

Apparatus for forming an image, comprising a storage for storing a digitized image and a receiver. The receiver includes a matrix, a thermomeltable material disposed in the matrix having a transition temperature range which is above room temperature wherein the viscosity of the thermomeltable material decreases substantially from below to above the transition temperature range, and field-driven particles immersed in the thermomeltable material, so that the particles change optical densities in response to an applied electric field when the thermomeltable material is above the transition temperature range and is stable at temperatures below the transition temperature range. An array of electrodes selectively applies electric fields at an image forming position on the receiver. The apparatus heats the receiver to control the temperature of the receiver to control the response of the field-driven particles in the receiver. Electronic control circuitry coupled to the heater controls the temperature of the receiver when an electric field is applied and coupled to the electrode array for selectively applying voltages to the electrode array so that electric fields are applied at the image forming position at particular locations on the receiver corresponding to pixels in response to the stored image whereby the electrodes produces an image in the receiver corresponding to the stored image.

15 Claims, 5 Drawing Sheets

COLOR IMAGE FORMATION IN RECEIVERS HAVING FIELD-DRIVEN PARTICLES

CROSS REFERENCE TO RELATED APPLICATIONS

Reference is made to commonly assigned U.S. patent application Ser. No. 09/012,842 filed Jan. 23, 1998, entitled "Addressing Non-Emissive Color Display Device" to Wen et al; U.S. patent application Ser. No. 09/035,516 filed Mar. 5, 1998, entitled "Heat Assisted Image Formation in Receivers Having Field-Driven Particles" to Wen et al; U.S. patent application Ser. No. 09/034,066 filed Mar. 3, 1998, entitled "Printing Continuous Tone Images on Receivers Having Field-Driven Particles" to Wen et al; U.S. Pat. application Ser. No. 09/037,229 filed Mar. 10, 1998, entitled "Calibrating Pixels in a Non-emissive Display Device" to Wen et al. The disclosure of these related application is incorporated herein by reference.

FIELD OF THE INVENTION

This invention relates to an image forming apparatus for producing color images on a receiver comprising field-driven particles.

BACKGROUND OF THE INVENTION

There are several types of field-driven particles in the field of non-emissive displays. One class uses the so-called electrophoretic particle that is based on the principle of movement of charged colloidal particles in an electric field. In an electrophoretic display, the charged particles containing different reflective optical densities can be moved by an electric field to or away from the viewing side of the display, which produces a contrast in the optical density. Another class of field-driven particles are particles carrying an electric dipole. Each pole of the particle is associated with a different optical densities (bi-chromatic). The electric dipole can be aligned by a pair of electrodes in two directions, which orient each of the two polar surfaces to the viewing direction. The different optical densities on the two halves of the particles thus produces a contrast in the optical densities.

To produce a high quality image it is essential to form a plurality of image pixels by varying the electric field on a pixel wise basis. The electric fields can be produced by a plurality pairs of electrodes embodied in the receiver as disclosed in U.S. Pat. No. 3,612,758. A shortcoming is that this solution requires the incorporation of electrodes in the receiver, increasing the receiver complexity.

One difficulty in above described non-emissive display is in displaying color images. The field-driven particles of different colors can be provided in discrete color pixels. This approach requires the colored particles to be placed accurately. Moreover, the electrodes that drive the colored particles also need to in precise registration to the color pixels when different color image planes are formed. This approach is therefore complex and expensive.

The field-driven particles of different colors can also be stacked in layers. But since the field-driven particles are usually opaque and scatter light, the color layers under the top color layer normally receives less input light and reflect less corresponding colored light back to the viewers. The lower color layers therefore have low color reflection densities.

An additional problem in the receivers comprising field-driven particles is forming images which are stable. Typically the images on these receivers must be periodically reformed to keep the image from degrading.

SUMMARY OF THE INVENTION

It is an object of the present invention to provide a receiver which is highly stable and can be used in an image forming apparatus for producing color images.

A further object of the present invention is to provide a receiver which can produce color images that are highly stable.

These objects are achieved by apparatus for forming an image, comprising:

a) storage means for storing a digitized image;

b) a receiver comprising:
   i) a matrix;
   ii) a thermomeltable material disposed in the matrix, having a transition temperature range which is above room temperature wherein the viscosity of the thermomeltable material decreases substantially from below to above the transition temperature range; and
   iii) field-driven particles, immersed in the thermomeltable material, so that the field-driven particles change reflective densities in response to an applied electric field when the material is above the transition temperature range and is stable at temperatures below its transition temperature range;

c) an array of electrodes associated with the receiver for selectively applying electric fields at an image forming position on the receiver;

d) means for heating the receiver to control the temperature of the receiver to control the response of the field-driven particles in the receiver; and e) electronic control means coupled to the heater for applying heat to control the temperature of the receiver to selectively control the response of the colored field-driven particles when an electric field is applied and coupled to the electrode array for selectively applying voltages to the electrode array so that electric fields are applied at the image forming position at particular locations on the receiver corresponding to pixels in response to the stored image whereby the electrodes produces a color image in the receiver corresponding to the stored image.

In another aspect of the present invention, the object is achieved by using a receiver for forming images, comprising:

a) a substrate;

b) a layer having a matrix disposed over the substrate and including
   i) a thermomeltable material disposed in the matrix, having a transition temperature range which is above room temperature wherein the viscosity of the thermomeltable material decreases substantially from below to above the transition temperature range; and
   ii) field-driven particles, immersed in the thermomeltable material, so that the field-driven particles change reflective densities in response to an applied electric field when the material is above the transition temperature range and is stable at temperatures below its transition temperature range.

ADVANTAGES

An advantage of the present invention is that the colored field-driven particles can be provided in a receiver without forming spatially discrete color pixels.

Another advantage of the present invention is that the colored field-driven particles can be addressed in overlapping color pixels so that the spatial resolution is not compromised from monochromatic to color image display having field-driven particles.

A feature of the present invention is that the viscous material surrounding the colored field driven particles are heated to permit fast image writing.

A further feature is to provide a receiver having field-driven particles which is highly stable at room temperature.

An additional advantage is that the image formed by the color field-driven particles on a receiver are stabilized by a viscous material below melting temperature when the image is displayed.

DETAILED DESCRIPTION OF THE INVENTION

Figure 1:
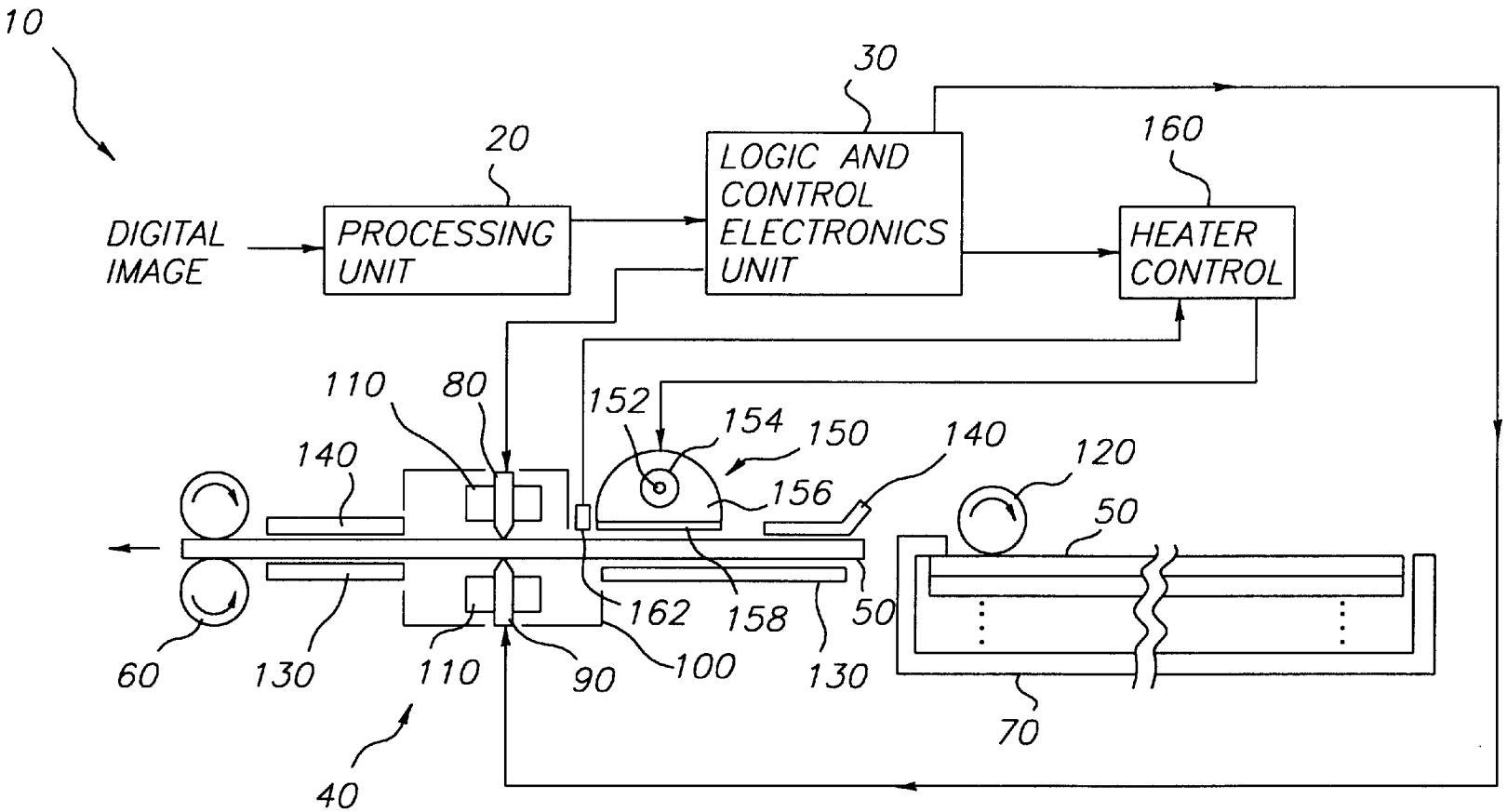
FIG. 1 shows an electronic printing apparatus in accordance to the present invention

FIG. 1 shows the electronic printing apparatus 10 in accordance to the present invention. The electronic printing apparatus 10 includes a processing unit 20, a logic and control electronics unit 30, a print head 40, a receiver 50 that comprises field-driven particles in a matrix (see FIG. 3), a receiver transport 60 shown as rollers, and a receptacle 70. The print head 40 includes an array of pairs of top electrodes 80 and bottom electrodes 90 (only one pair being shown) located at an image forming position and corresponding to each pixel of the image forming position on the receiver 50. The array of electrodes is contained in an electrode structure 110. The electrode structure 110 is formed using polystyrene as an insulating material. It is known that other insulating materials including ceramics and plastics can be used. An electric voltage is applied by logic and control electronics unit 30 across the pair of electrodes at each pixel location to produce the desired optical density at that pixel. An electrically grounded shield 100 is provided to shield print head 40 from external electric fields.

The receiver 50 is shown to be picked by a retard roller 120 from the receptacle 70. Other receiver feed mechanisms are also compatible with the present invention: for example, the receiver can be fed by single sheet or by a receiver roll equipped with cutter. The term "receptacle" will be understood to mean a device for receiving one or more receivers including a receiver tray, a receiver roll holder, a single sheet feed slot etc. During the printing process, the receiver 50 is supported by the platen 130 and guided by the guiding plate 140, and is transported by the receiver transport 60. Other transport mechanisms known to one skilled in the art are equally suited for use in this invention.

The electronic printing apparatus 10 in FIG. 1 is shown to further include a heater 150 and a heater control 160. The heater 150 includes the heating element 152, the tube 154, the reflector 156 and the cover 158. The heater 150 is controlled by the heater control 160 for providing thermal energy to receiver 50 before and/or during an electric field is applied to an area on the receiver 50 by electrodes 80 and 90. The purpose of the heater 150 is to heat the receiver 50 and regulate the temperature so as to control the response of electric field-driven particles 200–202 in receiver 50. This will be discussed in relation to FIG. 3.

The heater 150 in FIG. 1 is shown to be a radiant heater in which the heating element 152 can be a coiled electrically resistive wire and the tube 154 can be made of quartz. The heating element 152 is surrounded by the tube 154 for protecting the heating element 152 from damage. The tube 154 also provides physical support to the entire length of the heating element 152. In addition, the tube 154 electrically insulates the heating element 150 from the surroundings and protects the heating element 152 from damaging other components in the heater 150. The material selected for heating element 152 and tube 154 should possess durability at high temperature through a multiplicity of thermal cycles. Examples of such materials as suitable for use heating element 152 are "NICHROME", a Nickel—Chromium Alloy, and iron chromium aluminum alloys. "NICHROME" is a trademark of Driver-Harris Company located in Harrison, N.J. Tube 154 may be quartz. It is appreciated by a person of ordinary skill in the art that metal sheathed heating elements or exposed wire heaters may also be used. Electrical current flowing through heating element 152 causes heating element 152 to heat, thereby generating radiant heat emanating therefrom.

Although a radiant heater is described above in relation to FIG. 1, it is understood that many other heater types are compatible with the present invention. For example, the heater can include contact type, a convection type etc.

The heating element 152 and the tube 154 in the heater 150 are shown to be housed in a reflector 156 that is made of a substantially reflective material, such as polished aluminum, partially surrounds tube 154. The reflector 156 is preferably parabolic-shaped and is arranged so as to reflect the radiant heat energy onto to receiver 50. The reflector 156 preferably reflects the heat at a high thermal efficiency ratio. As used herein, the terminology "thermal efficiency ratio" is defined to mean the quantity of heat energy reaching receiver 50 divided by the quantity of total heat energy emitted by heating element 152.

The cover 158 is a substantially heat transparent. It is disposed across the open side of the reflector 156. The cover 158 may be a metal screen or sheet metal with punched holes for preventing receiver 50 from inadvertently contacting tube 154 while simultaneously permitting a sufficient quantity of radiant heat flux to pass through. A sensor 162 which senses the temperature adjacent to the receiver 50 in the image forming position, provides a signal to the heater control 160 representative of the temperature of the receiver 50. The sensor 162 monitors the temperature at the receiver 50 and the heater control 160 adjusts the amount of the electric power applied by the heater 150, which determines the thermal energy applied to the receiver 50. A typical temperature range sensed by the sensor 162 is 30° C. to 150° C. The logic and control electronics unit 30 responds to the processing unit 20 and turns on the heat control 160 before the processing unit delivers image data to the logic and control electronics units 30 for application to top electrodes 80. Before the logic and control electronics unit 30 delivers data to the electrodes 80 and 90, the temperature sensed by sensor 162 reaches a sufficient level (above room temperature) for the corresponding color image plane indicating that the mobility of the field-driven particles in the matrix of the receiver 50 is high enough for efficient printing.

Figure 2:
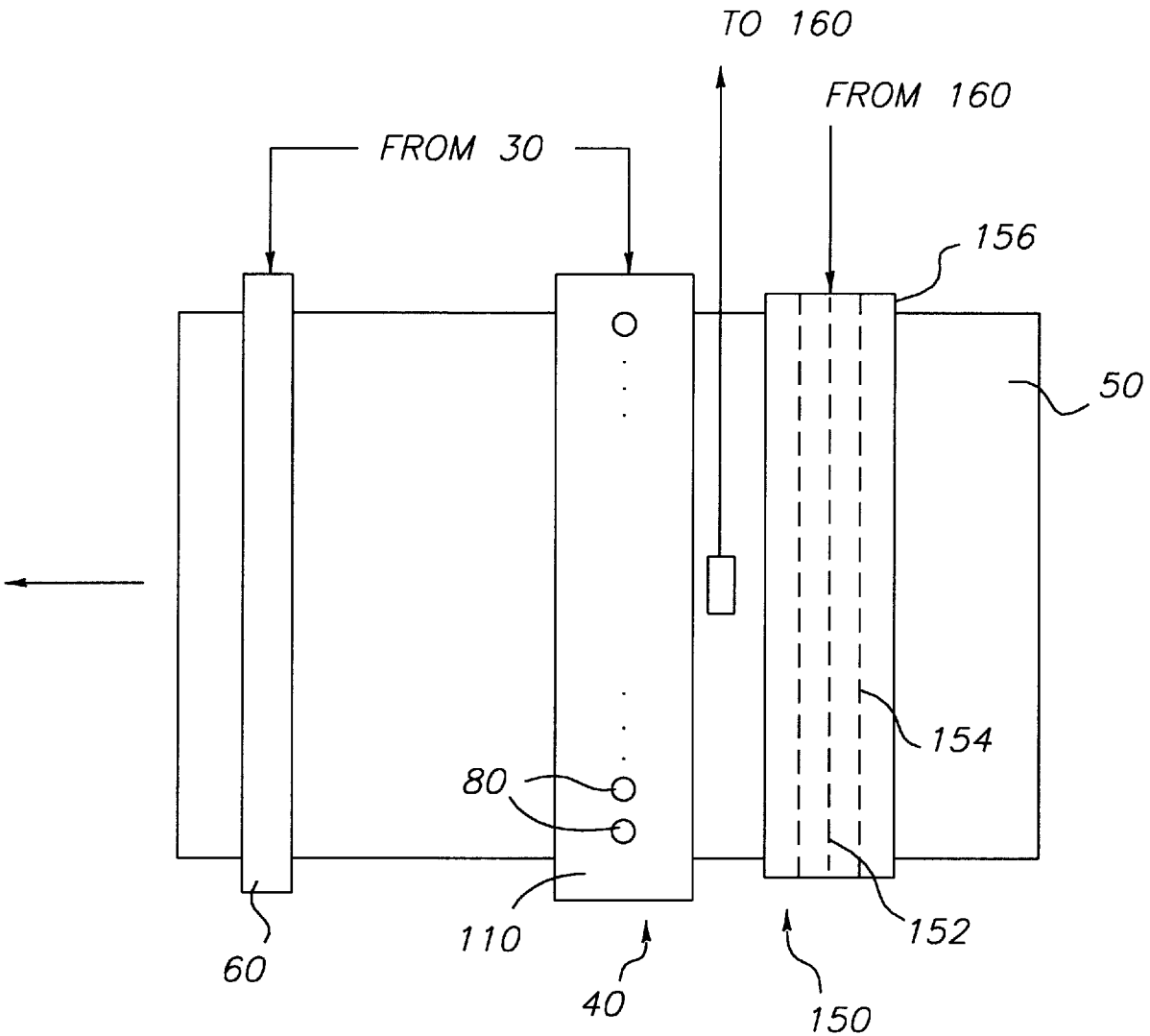
FIG. 2 shows a top view of the structure around the print head in the electronic printing apparatus of FIG. 1.

FIG. 2 shows a top view of the structure around the print head 40. For clarity reasons, only selected components are shown. The receiver 50 is shown to be transported under the print head 40 by the receiver transport 60. The print head 40 is shown to include a plurality of top electrodes 80, each corresponding to one pixel. The top electrodes 80 are located within holes in the electrode structure 110. The bottom electrodes 90 of FIG. 1 are also disposed in an electrode structure 110. The electrodes are distributed in a linear fashion as shown in FIG. 2 to minimize electric field fringing effects between adjacent pixels printed on the receiver 50. Different printing resolutions are achievable across the receiver 50 by the different arrangements of the top electrodes 80, including different electrode spacing. The printing resolution down the receiver 50 can also be changed by controlling the receiver transport speed by the receiver transport 60 or the rate of printing by controlling the logic and control electronics unit 30. The heater 150, that is controlled by heater control 160, is shown upstream to the print head 40. The heating element 152 and the tube 154 are also shown.

Figure 3:
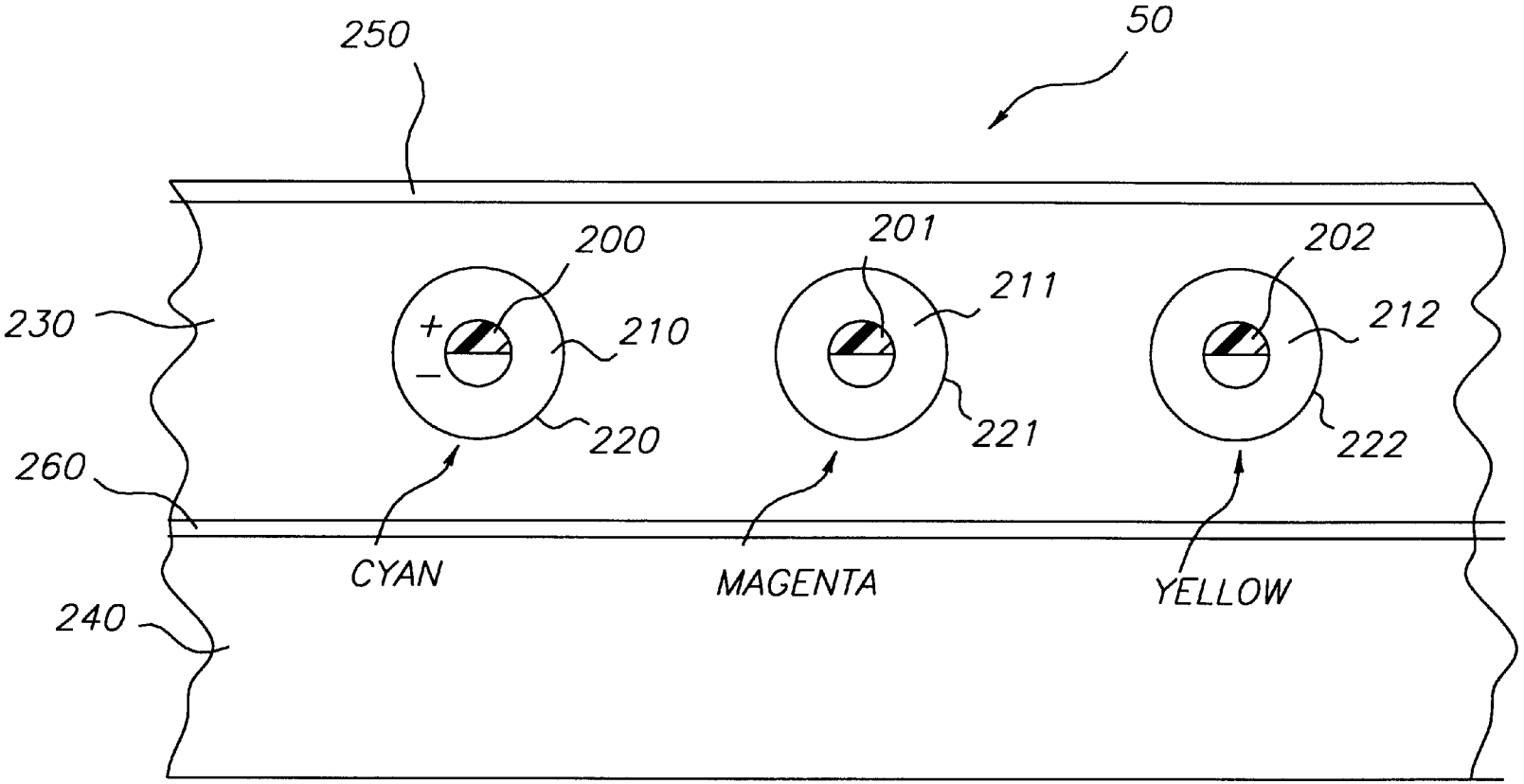
FIG. 3 shows a cross sectional view of a receiver having colored field-driven particles of FIG. 1 in accordance with the present invention.

FIG. 3 shows a cross sectional view of the receiver 50 of FIG. 1. The receiver 50 includes a plurality of field-driven particles, cyan field-driven particles 200, magenta field-driven particles 201, and yellow field-driven particles 202. The field-driven particles are exemplified by bi-chromatic particles, that is, half of the particle is white and the other half is of a different color density such as black, yellow, magenta, cyan, red, green, blue, etc. The cyan field-driven particles 200 are half cyan and half white. The magenta field-driven particles 201 are half magenta and half white. The yellow field driven particles 202 are half yellow and half white. The bi-chromatic particles are electrically bi-polar. Each of the color surfaces (e.g. white and black) is aligned with one pole of the dipole direction. It will be understood that the field-driven particles 200–202 may vary in characteristics such as particle size, particle density, or particle charge without substantially modifying the present invention. The stable field-driven particles 200–202 are immersed in a thermomeltable materials 210–212 which are together encapsulated in respective microcapsule 220–222. The cyan field-driven particles 200 are immersed in a thermomeltable material for cyan field-driven particles 200 and together encapsulated in a microcapsule for cyan field-driven particles 220. The magenta field-driven particles 201 are immersed in a thermomeltable material for magenta field-driven particles 211 and together encapsulated in a microcapsule for magenta field-driven particles 221. The yellow field-driven particles 202 are immersed in a thermomeltable material for yellow field-driven particles 212 and together encapsulated in a microcapsule for yellow field-driven particles 222.

The term thermomeltable material will be understood to mean a material which substantially decreases its viscosity when its' temperature is raised from below to above a transition temperature (range). The transition temperature range typically corresponds to a transition in chemical phase or physical configuration. Examples of the transition include melting (and freezing), solidifying, hardening, glass transition, chemical or physical polymerization, aggregation or association of particles or molecules. When the temperature of the thermomeltable material is varied from above to below the transition temperature, the viscosity typically increases at least a factor of five, and preferably ten times or larger. The mobility of the field-driven particles is inversely related to the viscosity of the thermomeltable material the field-driven particles are immersed in. The materials for the thermomeltable materials are each different having different transition temperature ranges and are discussed below. The microcapsules are immersed in a matrix 230 which is in the form of a deposited layer. The preferred embodiment permits the microcapsules to be randomly dispersed, however the microcapsules may also be formed in a regular pattern without affecting the present invention.

A substantial change in the viscosity of the thermomeltable material is defined by the effects on the field-driven particles. When immersed in such thermomeltable materials, the field-driven particles are immobile at temperatures below the transition temperature: that is, the field-driven particles do not change their physical configurations in the presence of an external (e.g. electric) field or thermodynamic agitation. At temperature above the transition temperature, the field-driven particles can respond (rotation or translation) to the external field to permit the change in color reflective densities. Typically, a thermomeltable material needs to changes viscosity a factor of five or larger through the transition.

The matrix 230 is disposed on a substrate 240. A subbing layer 260 provides increased adhesion between the matrix 230 and the substrate 240. The material of the substrate 240 preferably provides the receiver a look and the feel of the high quality paper (e.g. photographic paper). The substrate 240 controls the flexibility and durability of the receiver 50. The substrate 240 can include natural or synthetic paper, polymer film. In some applications, rigid substrate such as glass and ceramics can also be used. A protective top coat 250 is disposed on the matrix 230 to protect the matrix 230 and to provide a surface treatment (matte or gloss). The subbing layer 260 may be made conductive to improve image forming characteristics as disclosed in commonly assigned U.S. patent application Ser. No. 09/034,066 filed Mar. 3, 1998, "Printing Continuous Tone Images on Receivers Having Field-Driven Particles" to Wen et al.

An electric field induced in the microcapsules, when the thermomeltable material is in a low viscosity state, align the field-driven particles to a low energy direction in which the dipole opposes the electric field. When the field is removed the particles state remains unchanged. When the thermomeltable material is in a high viscosity state the field driven particles are unaffected by the electric field. FIG. 3 shows the cyan field-driven particle 200 in the cyan state as a result of field previously imposed, by a negative top electrode 80 of FIG. 1 and positive bottom electrode 90 of FIG. 1, during a low viscosity state of the thermomeltable material for cyan field-driven particles 210. If the polarity of the field had been reversed, during the low viscosity state of the thermomeltable material for cyan field-driven particles 210, the cyan field-driven particle 200 would be in the white state. FIG. 3 also shows the magenta field-driven particle 201 in the magenta state as a result of field previously imposed, by a negative top electrode 80 of FIG. 1 and positive bottom electrode 90 of FIG. 1, during a low viscosity state of the thermomeltable material for magenta field-driven particles 211. If the polarity of the field had been reversed, during the low viscosity state of the thermomeltable material for magenta field-driven particles 211, the magenta field-driven particle 201 would be in the white state. FIG. 3 further shows the yellow field-driven particle 202 in the yellow state as a result of field previously imposed, by a negative top electrode 80 of FIG. 1 and positive bottom electrode 90 of FIG. 1, during a low viscosity state of the thermometable material for yellow field-driven particles 212. If the polarity of the field had been reversed, during the low viscosity state of the thermometable material for yellow field-driven particles 212, the yellow field-driven particle 202 would be in the white state. The present invention has been described as a three color device, it is understood that the invention could also be embodied in any number of colors without substantially modifying the invention. In particular the present invention could be used with a monochrome receiver thus providing the benefit of improved image stabilization.

The field-driven particles can include many different types, for example, the bi-chromatic dipolar particles and electrophoretic particles. In this regard, the following disclosures are herein incorporated in the present invention. Details of the fabrication of the bi-chromatic dipolar particles and their addressing configuration are disclosed in U.S. Pat. Nos. 4,143,103; 5,344,594; and 5,604,027; and in "A Newly Developed Electrical Twisting Ball Display" by Saitoh et al p249–253, Proceedings of the SID, Vol. 23/4, 1982, the disclosure of these references are incorporated herein by reference. Another type of field-driven particle is disclosed in PCT Patent Application WO 97/04398. It is understood that the present invention is compatible with many other types of field-driven particles that can display different color densities under the influence of an electrically activated field.

As noted above the thermometable materials each have different transition temperature ranges. The thermometable materials are chosen to have transition temperature ranges which are different and do not overlap. The transition temperature range is preferably chosen to be well above room temperature to stabilize the image at room temperature. Examples of the thermometable materials and their transition temperatures are listed in Table I. The thermometable material for cyan field driven particles 210 is selected to be carnuba wax (corypha cerifera) which has a transition temperature range of 86–90° C. The thermometable material for magenta field driven particles 211 is selected to be beeswax (apis mellifera) which has a transition temperature range of 62–66° C. The thermometable material for yellow field driven particles 212 is selected to be myrtle wax (myria cerifera) which has a transition temperature range of 39–43° C. The thermometable materials are each waxes which solidify as the thermometable material temperature is decreased through the transition temperature range. Below the transition temperature range, the viscosity of the thermometable materials is substantially higher (solid) than at temperatures above the transition temperature range. Although waxes are used in the present invention other materials are equally compatible, provided they are selected to have differing transition temperature ranges. Several thermometable materials are shown in Table 1. It is understood that other thermometable materials may used in the present invention without substantially affecting the performance.

TABLE 1

| Thermometable Material | Transition temperature range (° C.) | Comment |
|---|---|---|
| Myrtle Wax | 39–43[1] | Myria Cerifera |
| Beeswax | 62–66[1] | Apis Melifera |
| Carnuba Wax | 86–90[1] | Corypha Cerifera |

TABLE 1-continued

| Thermometable Material | Transition temperature range (° C.) | Comment |
|---|---|---|
| Eicosane $C_{20}H_{42}$ | 38[1] | |
| Triacontane $C_{30}H_{62}$ | 66.1[1] | |
| Pentatriacontane $C_{35}H_{72}$ | 74.7[1] | |
| Tetracosane $C_{24}H_{50}$ | 51.1[1] | |
| X-8040 Baker-Petrolite | 79[2] | Alpha olefin/maleic anhydride copolymer |
| Vybar 260 Baker-Petrolite | 54[2] | Ethylene derived hydrocarbon polymer |
| Vybar 103 Baker-Petrolite | 74[2] | Ethylene derived hydrocarbon polymer |

[1]Handbook of Chemistry and Physics, CRC Publishers, 42nd Edition, 1960–1961
[2]Technical Information, Baker-Petrolite, Tulsa, OK. 1998

Figure 4:
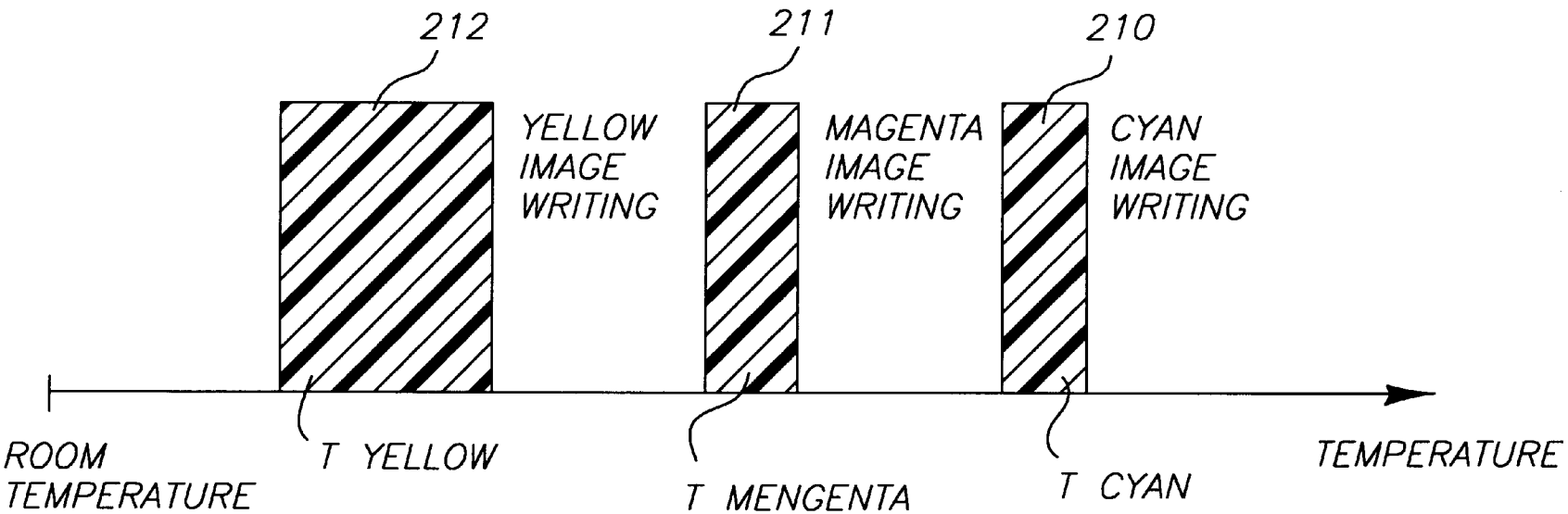
FIG. 4 is an illustration of the melting temperatures of the material in microcapsules and the temperature ranges for writing different color images.

FIG. 4 shows a plot of the exemplified transition temperature ranges of the thermometable materials (210–212) of receiver 50 (FIG. 3). In this example the thermometable material for cyan field-driven particles 210 is shown to have a transition temperature range $T_{cyan}$. The cyan images is written at temperatures above this transition temperature range. The thermometable material for magenta field-driven particles 211 is shown to have a transition temperature range $T_{magenta}$. The magenta image is written at temperatures above this transition temperature range and below the $T_{cyan}$ transition temperature range. The thermometable material for yellow field-driven particles 211 is shown to have a transition temperature range $T_{yellow}$, The yellow image is written at temperatures above this transition temperature range and below the $T_{magenta}$ transition temperature range. The order of the transition temperature ranges can be changed with appropriate changes to the operating procedure.

Referring to FIG. 1, a typical operation of the electronic printing apparatus 10 is described in the following. A user sends a digital image to the processing unit 20. Processing unit 20 receives the digital image storing it in internal storage. All processes are controlled by processing unit 20 via logic and control electronics unit 30. A receiver 50 is picked from receptacle 70 by retard roller 120. The receiver 50 is advanced until the leading edge engages receiver transport 60. Retard roller 120 produces a retard tension against receiver transport 60 which controls motion of the receiver 50. The receiver 50 is heated by heater 150 before or during an image area is written by print head 40. The amount of the heating power is controlled by heater control 160. The heater applies thermal energy to the receiver 50 and raises the temperature of the thermometable materials in the microcapsules (FIG. 3). The heater 150 raises the receiver 50 to a first temperature above the transition temperature range for the thermometable material for cyan field driven particles 210 (FIG. 3). At this temperature the thermometable material for cyan field-driven particles 210 is in a low viscosity state.

The logic and control electronics unit 30 is in communication with the heater control 160. The heating power of the heater 150, the writing time of the print head 40, and the electric voltage across the top electrode 80 and the bottom electrode 90 can be optimized for the most desired image quality and printing productivity of the electronic printing apparatus 10.

As the receiver 50 is moved past the image forming position between the array of pairs of electrodes, the receiver is heated to a temperature above the transition temperature range for the thermometable material for cyan field-driven particles 210. Each pixel of the digital cyan image is produced by an electric field applied by the pair of the electrodes, top electrode 80 and bottom electrode 90. Each pair of electrodes is driven complementary, bottom electrode 90 presents a voltage of opposite polarity to the voltage produced by top electrode 80, each voltage referred to as ground. Each pixel location is driven according to the input digital image to produce the desired optical density as described in FIG. 3. The voltages are applied as a waveform, the first state of the waveform a positive voltage is applied to the top electrode 80 causing the cyan field-driven particle 200 to a white state. In the second state of the waveform a negative voltage is applied to the top electrode 80 for at a specific amplitude and duration, as determined by calibration data, causing a desired cyan optical density to be produced. For a more detailed description see commonly assigned U.S. patent application Ser. No. 09/034,066 filed Mar. 3, 1998, entitled "Printing Continuous Tone Images on Receivers Having Field-Driven Particles" to Wen et al. The field-driven particles for the other colors have been written with the cyan image. This side effect will be eliminated by the erasure of these colors after the stabilization of the cyan image. The pixel data is selected from the digital image data to adjust for the relative location of each electrode pair and transport motion. The receiver transport 60 advances the receiver 50 a displacement which corresponds to a pixel pitch. The next set of pixels is written according to the current position. The process is repeated until the entire image is written. The retard roller 120 disengages as the process continues and the receiver transport 60 continues to control motion of the receiver 50. The receiver transport 60 moves the receiver 50 out of the electronic printing apparatus 10 to eject the print. The receiver transport 60 and the retard roller 120 are close to the image forming position under the electrodes 80 and 90, this improves control over the receiver motion and improves print quality.

After the cyan image is written by the print head 40, the receiver 50 is cooled down to a temperature below the transition temperature range for the thermometable material for cyan field-driven particles 210. At this temperature the thermometable material for cyan field-driven particles 210 is in a high viscosity state and the mobility of the cyan field-driven particles 200 is reduced, stabilizing the cyan image on the receiver 50.

The receiver 50 is passed under the image forming position a second time. In this pass the heater 150 maintains the temperature between the transition temperature ranges for the thermometable material for cyan field-driven particles 210 and the thermometable material for magenta field-driven particles 211. The thermometable material for magenta field driven particles 211 is in a low viscosity state. The thermometable material for cyan field driven particles 210 is in a high viscosity state and the cyan field-driven particles are therefore immobile in the presence of the electric fields for writing the magenta (and yellow) image. This permits the magenta image to be written without affecting the cyan image. The magenta image is erased and then written in a manner similar to the cyan image. The yellow field-driven particles 202 are written with the magenta image, and will be erased later. After the magenta image is written by the print head 40, the receiver 50 is cooled down to a temperature below the transition temperature range for the thermometable material for magenta field-driven particles 211. At this temperature the thermometable material for magenta field-driven particles 211 is in a high viscosity state and the mobility of the magenta field-driven particles 201 is reduced, stabilizing the magenta image on the receiver 50.

The receiver 50 is passed under the image forming position a third time. In this pass the heater 150 maintains the temperature between the transition temperature ranges for the thermometable material for yellow field-driven particles 212 and the thermometable material for magenta field-driven particles 211. The thermometable material for yellow field driven particles 210 is in a low viscosity state. The thermometable material for cyan field driven particles 210 is in a high viscosity state and magenta field driven particles 211 is in a high viscosity state. This permits the yellow image to be written without affecting the cyan or magenta image. The yellow image is erased and then written in a manner similar to the cyan and magenta images. After the yellow image is written by the print head 40, the receiver 50 is cooled down to a temperature below the transition temperature range for the thermometable material for yellow field-driven particles 212. At this temperature the thermometable material for yellow field-driven particles 212 is in a high viscosity state and the mobility of the yellow field-driven particles 202 is reduced, stabilizing the yellow image on the receiver 50.

Figure 5:
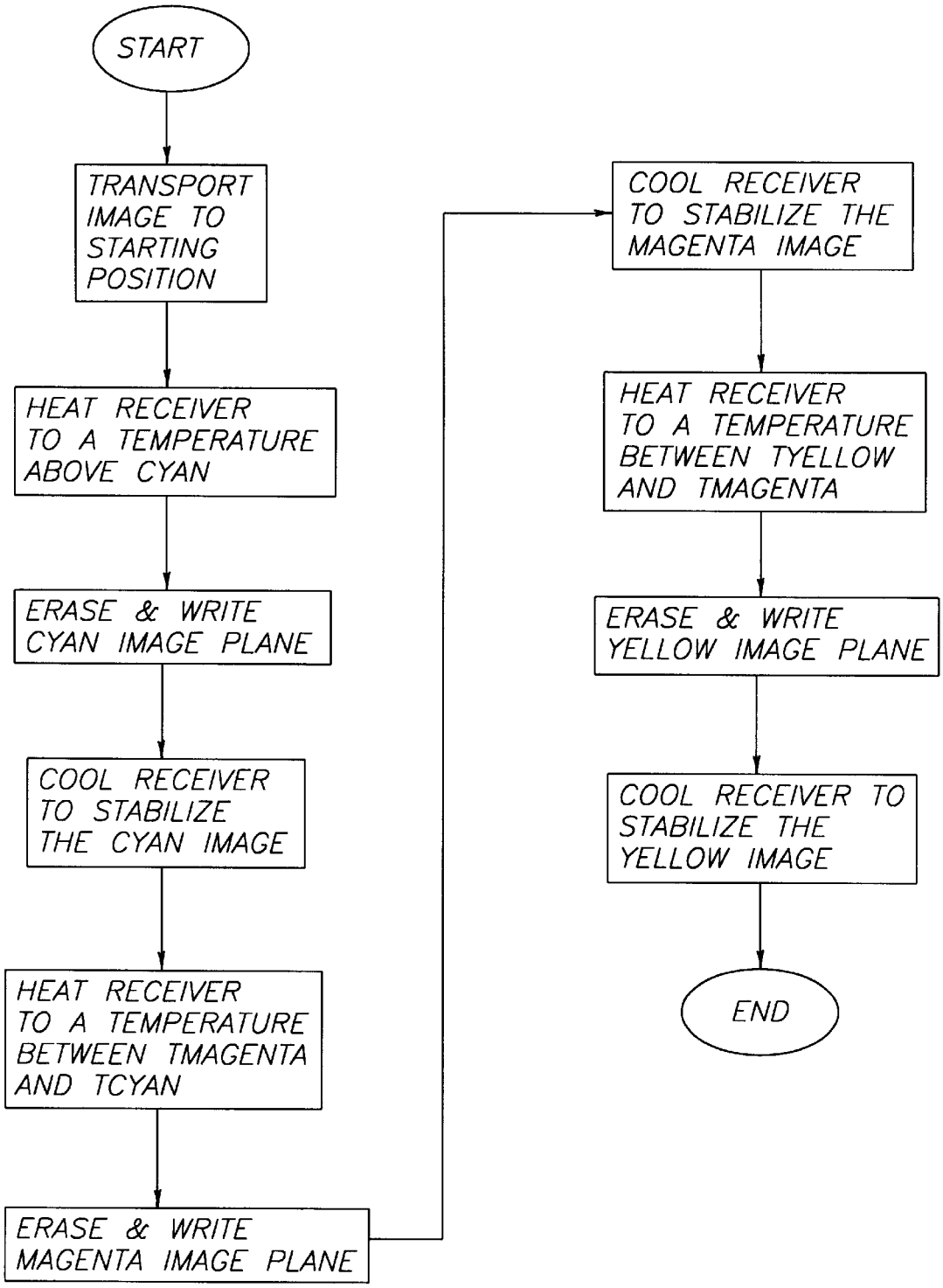
FIG. 5 schematically shows a flow diagram for producing color images on a receiver having color field-driven particles in accordance with the present invention.

FIG. 5 schematically shows a flow chart of the key points of the above process. The image is transported to a starting position. The receiver 50 is heated to a temperature above $T_{cyan}$. The cyan field-driven particles 200 are erased and then written imagewise. The receiver is cooled to stabilize the cyan image. The receiver 50 is heated to a temperature between $T_{magenta}$ and $T_{cyan}$. The magenta field-driven particles 201 are erased and then written imagewise. The receiver is cooled to stabilize the magenta image. The receiver 50 is heated to a temperature above $T_{yellow}$. The yellow field-driven particles 202 are erased and then written imagewise. The receiver is cooled to stabilize the yellow image. The entire image is thus stabilized.

Briefly reviewing the operation of the logic and control electronics unit 30 of FIG. 1. It is coupled to the heater 150 for applying heat to control the temperature of the receiver 50 to selectively control the response of the field-driven particles 200–202 when an electric field is applied and coupled to the electrode array 80 for selectively applying voltages to the electrode array 80 so that electric fields are applied at the image forming position at particular locations on the receiver 50 corresponding to pixels in response to the stored image whereby the electrode array 80 produces the image in the receiver corresponding to the stored image.

The invention has been described in detail with particular reference to certain preferred embodiments thereof, but it will be understood that variations and modifications can be effected within the spirit and scope of the invention.

PARTS LIST

| | |
|---|---|
| 10 | electronic printing apparatus |
| 20 | processing unit |
| 30 | logic and control electronics unit |
| 40 | print head |
| 50 | receiver |
| 60 | receiver transport |
| 70 | receptacle |
| 80 | top electrodes |
| 90 | bottom electrodes |
| 100 | electrically grounded shield |
| 110 | electrode structure |
| 120 | retard roller |

-continued

| PARTS LIST | |
|---|---|
| 130 | platen |
| 140 | guiding plate |
| 150 | heater |
| 152 | heating element |
| 154 | tube |
| 156 | reflector |
| 158 | cover |
| 160 | heater control |
| 162 | sensor |
| 200 | cyan field-driven particle |
| 201 | magenta field-driven particle |
| 202 | yellow field-driven particle |
| 210 | thermometable material for cyan field-driven particle |
| 211 | thermometable material for magenta field-driven particle |
| 212 | thermometable material for yellow field-driven particle |
| 220 | microcapsule for cyan field-driven particle |
| 221 | microcapsule for magenta field-driven particle |
| 222 | microcapsule for yellow field-driven particle |
| 230 | matrix |
| 240 | substrate |
| 250 | protective top coat |
| 260 | subbing layer |

What is claimed is:

1. Apparatus for forming an image, comprising:

a) storage means for storing a digitized image;

b) a receiver comprising:

i) a matrix;

ii) a thermometable material disposed in the matrix, having a transition temperature range which is above room temperature wherein the viscosity of the thermometable material decreases substantially from below to above the transition temperature range; and iii) field-driven particles, immersed in the thermometable material, so that the field-driven particles change reflective densities in response to an applied electric field when the material is above the transition temperature range and is stable at temperatures below its transition temperature range;

c) an array of electrodes associated with the receiver for selectively applying electric fields at an image forming position on the receiver;

d) means for heating the receiver to control the temperature of the receiver to control the response of the field-driven particles in the receiver; and e) electronic control means coupled to the heater for applying heat to control the temperature of the receiver to selectively control the response of the field-driven particles when an electric field is applied and coupled to the electrode array for selectively applying voltages to the electrode array so that electric fields are applied at the image forming position at particular locations on the receiver corresponding to pixels in response to the stored image whereby the electrodes produces the image in the receiver corresponding to the stored image.

2. The apparatus of claim 1 wherein the receiver thermometable material is selected from the group consisting of wax, hydrocarbon polymers, and alpha olefin/maleic anhydride copolymers.

3. The apparatus of claim 1 wherein the field-driven particles include electrophoretic particles or dipolar bi-chromatic particles.

4. Apparatus for forming a color image, comprising:

a) storage means for storing a digitized image;

b) a receiver comprising:

i) a matrix;

ii) at least two different thermometable materials separately disposed in the matrix, each material having a different transition temperature range which is above room temperature wherein the viscosity of the thermometable material decreases substantially from below to above the transition temperature range; and iii) at least two different colored field-driven particles, each immersed in a particular one of the different thermometable materials, so that a particular color particle changes color reflective densities in response to an applied electric field when its corresponding thermometable material is above the transition temperature range and is stable at temperatures below its respective transition temperature range;

c) an array of electrodes associated with the receiver for selectively applying electric fields at an image forming position on the receiver;

d) means for heating the receiver to control the temperature of the receiver to control the response of the colored field-driven particles in the receiver; and e) electronic control means coupled to the heater for applying heat to control the temperature of the receiver to selectively control the response of the colored field-driven particles when an electric field is applied and coupled to the electrode array for selectively applying voltages to the electrode array so that electric fields are applied at the image forming position at particular locations on the receiver corresponding to pixels in response to the stored image whereby the electrodes produces a color image in the receiver corresponding to the stored image.

5. The apparatus of claim 4 wherein the receiver thermometable materials are selected from the group consisting of wax, hydrocarbon polymers, and alpha olefin/maleic anhydride copolymers.

6. The apparatus of claim 4 wherein the colored field-driven particles include electrophoretic particles or dipolar bi-chromatic particles.

7. A receiver for forming images, comprising:

a) a substrate;

b) a layer having a matrix disposed over the substrate and including i) a thermometable material disposed in the matrix, having a transition temperature range which is above room temperature wherein the viscosity of the thermometable material decreases substantially from below to above the transition temperature range; and ii) field-driven particles, immersed in the thermometable material, so that the field-driven particles change reflective densities in response to an applied electric field when the material is above the transition temperature range and is stable at temperatures below its transition temperature range.

8. The receiver of claim 7 wherein the thermometable material is selected from the group consisting of wax, hydrocarbon polymers, and alpha olefin/maleic anhydride copolymers.

9. The receiver of claim 7 wherein the field-driven particles include electrophoretic particles or dipolar bi-chromatic particles.

10. A receiver for forming colored images, comprising:

a) a substrate;

b) a layer having a matrix disposed over the substrate and including i) at least two different thermometable materials separately disposed in the matrix, each material having a different transition temperature range which is above room temperature wherein the viscosity of the thermomeltable material decreases substantially from below to above its transition temperature range; and ii) at least two different colored field-driven particles, each immersed in a particular one of the different thermomeltable materials, so that a particular color particle change color reflective densities in response to an applied electric field when its corresponding material is above the transition temperature range and is stable at temperatures below its respective transition temperature range.

11. The receiver of claim 10 wherein the thermomeltable materials are selected from the group consisting of wax, hydrocarbon polymers, and alpha olefin/maleic anhydride copolymers.

12. The receiver of claim 10 wherein the colored field-driven particles include electrophoretic particles or dipolar bi-chromatic particles.

13. A receiver for forming colored images, comprising:

a) a substrate;

b) a conductive layer disposed over the substrate; and c) a matrix disposed over the substrate and including i) at least two different thermomeltable materials separately disposed in the matrix, each material having a different transition temperature range which is above room temperature wherein the viscosity of the thermomeltable material decreases substantially from below to above the transition temperature range; and ii) at least two different colored field-driven particles, each immersed in a particular one of the different thermomeltable materials, so that a particular color particle change color reflective densities in response to an applied electric field when its corresponding material is above the transition temperature range and is stable at temperatures below its respective transition temperature range.

14. The receiver of claim 13 wherein the thermomeltable materials are selected from the group consisting of wax, hydrocarbon polymers, and alpha olefin/maleic anhydride copolymers.

15. The receiver of claim 13 wherein the colored field-driven particles include electrophoretic particles or dipolar bi-chromatic particles.

* * * * *